United States Patent [19]

Rothenberg, Jr.

[11] Patent Number: 4,521,203

[45] Date of Patent: Jun. 4, 1985

[54] TOY CONSTRUCTION KIT

[75] Inventor: Lee M. Rothenberg, Jr., Homewood, Ill.

[73] Assignee: International Honeycomb Corporation, Park Forest South, Ill.

[21] Appl. No.: 602,630

[22] Filed: Apr. 23, 1984

Related U.S. Application Data

[63] Continuation of Ser. No. 455,856, Jan. 5, 1983, abandoned.

[51] Int. Cl.[3] ..... E04B 1/10; A63H 33/00

[52] U.S. Cl. ..... 446/106; 446/124; 52/233

[58] Field of Search ..... 46/19, 20, 21, 23, 24, 46/25, 27, 28, 30; 52/233; 493/959, 966, 968; 446/106, 124

[56] References Cited

U.S. PATENT DOCUMENTS

| | | | |
|---|---|---|---|
| 2,059,598 | 11/1936 | Paulson | 46/20 |
| 2,708,329 | 5/1955 | McKee | 46/19 |
| 2,946,150 | 7/1960 | Houk | 52/233 |
| 3,473,277 | 10/1969 | Straight | 52/233 |
| 3,982,057 | 9/1976 | Briggs et al. | 493/966 |
| 4,197,341 | 4/1980 | Rule | 493/966 |

*Primary Examiner*—Robert P. Swiatek
*Assistant Examiner*—David I. Tarnoff
*Attorney, Agent, or Firm*—Dressler, Goldsmith, Shore, Sutker & Milnamow, Ltd.

[57] ABSTRACT

A toy construction kit comprising three basic elements, end blocks or logs, wall logs and enclosure panels. All of the logs, irrespective of length, are provided with at least one recess on each opposite face thereof for stacking, interlocking engagement with another log. Life-size play structures may be readily built and taken down without the use of fasteners, adhesives or tools. The elements are made of honeycomb sandwich kraft having exceptional length.

7 Claims, 4 Drawing Figures

TOY CONSTRUCTION KIT

This is application is a continuation of application Ser. No. 455,856, filed Jan. 5, 1983, which is now abandoned.

BACKGROUND OF THE INVENTION

This invention relates to toys and more particularly to toy kits of the type with which children can erect various building structures. More specifically, the invention relates to novel building blocks or logs for such toy constructions.

Among the most enjoyable of children's pastimes is the construction of and playing in their own building or house. Whether the building comprises tree house, a private club, a doll house, or a fort, the pleasure of dwelling in those private worlds is great and irresistible.

Unfortunately, the most common materials of construction are beset with disadvantages and even dangers when used for such purposes. For example, wood and lumber require the use of fasteners or adhesives and a variety of tools, most of which are beyond the capabilities of most youngsters. There is an ever present danger of injury from slivers, nails, and use of the tools required. In addition, structures so constructed are essentially permanent in nature and incapable of ready dismantling, storage and rebuilding when desired or necessary.

Other construction materials that have been employed include corrugated sheets, cartons and plastic building blocks. However, these materials also present well recognized problems, such as, danger of suffocation, blocking out of light and fragility of structure. There thus exists a need for a material of toy construction which overcomes all problems of the type alluded to.

SUMMARY OF THE INVENTION

The present invention provides novel building blocks which may be readily assembled into a variety of structures, including life-size enclosed structures, without the use of tools, fasteners or adhesives. The building blocks of the invention are in the form of logs of square cross section and may be made in a number of standard lengths. Each of the logs is provided with a standardized recess or notch for interlocking stacked logs to prevent lateral movement. At the same time, the interlocking cooperation of the logs affords spaces therebetween for the passage into the enclosed structure of air and filtered light.

Preferably, the logs of the invention are made of honeycomb sandwich kraft which has exceptional weight bearing strength. Logs made of honeycomb kraft are also very light and may be easily handled, even by children, for purposes of assembly, disassembly, and storage. The kit also includes roof panels made of honeycomb kraft.

Other features and advantages of the invention will be apparent from the following description and claims and are illustratre in the accompanying drawings which show structure embodying preferred features of the present invention and the principles thereof.

DETAILED DESCRIPTION OF THE INVENTION

Figure 1:
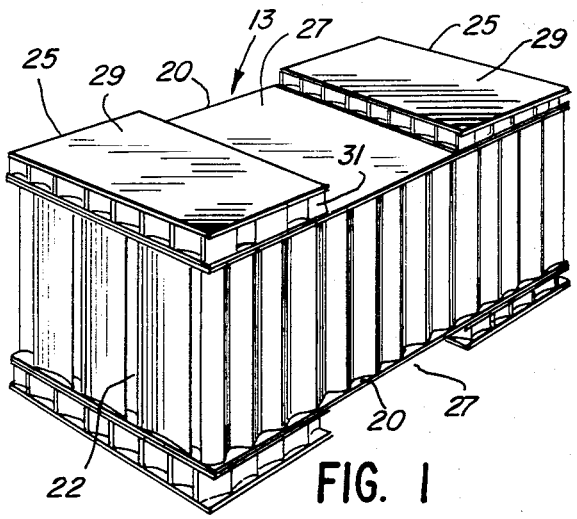
FIG. 1 is a perspective view of an end building block embodying the principles of the invention.
Figure 2:
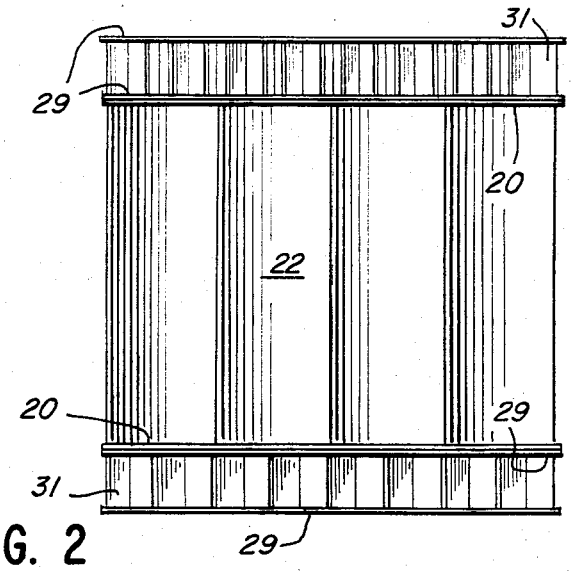
FIG. 2 is an end elevational view thereof.
Figure 3:
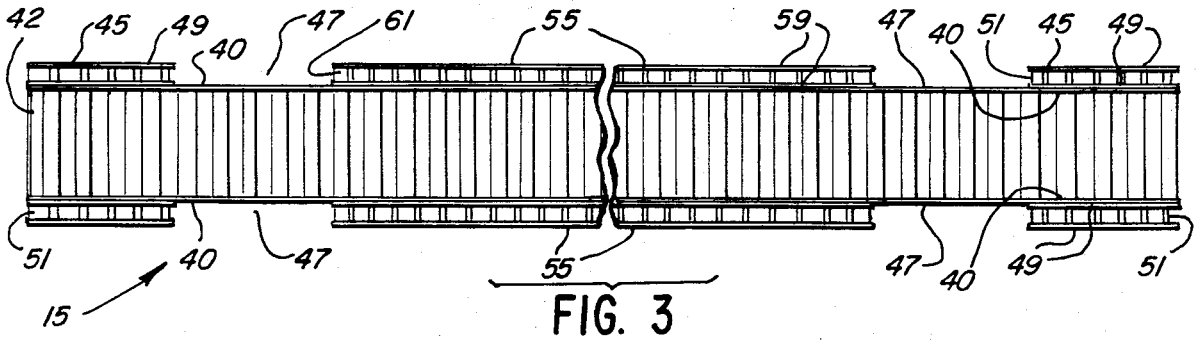
FIG. 3 is a side elevational view of another, or wall, building block, with portions broken out for ease of illustration.

Referring now with greater particularity to the drawings, it will be seen that the reference numeral 10 indicates generally a toy construction kit embodying the principles of the invention. The kit 10 comprises three basic elements, end blocks or logs 13, wall logs 15, and enclosure panels 17.

End log 13 comprises a multi-layered kraft paper block having top and bottom panels 20, 20, and a honeycomb core 22 sandwiched therebetween. The individual cells of the honeycomb core 22 may be of any desired cross-sectional configuration so long as the longitudinal axes thereof extend transversely between the panels 20.

Flat end riser sections 25 are permanently secured to the panels 20 adjacent the opposite ends thereof. The risers thus define a notch or recess 27 on the top and bottom surfaces of the log 13 for reasons which will become apparent as the description proceeds. While the riser sections 25 could comprise other materials and configurations, they preferably are of similar construction to the main body of the log and thus comprise rectangular kraft panels 29, 29 and a short honeycomb kraft core 31 sandwiched therebetween. One of the panels 29 is permanently glued to its associated panel 20 and said riser panels are co-extensive with the end portions of the associated panel 20 as illustrated. It will thus be appreciated that the log 13 comprises a three-tiered honeycomb structure through the riser sections 25 and a single honeycomb structure through the recesses 27.

The wall logs 15 are longer but of generally similar construction to the end logs 13. Wall log 15 thus comprises a pair of long, rectangular top and bottom panels 40, 40, and a honeycomb core 42 sandwiched therebetween. Flat end riser sections 45 comprising rectangular panels 49, 49 and a short honeycomb core 51 are permanently adhered to the opposite end surfaces of the panels 40. An elongated medial riser section 55 is permanently adhered to central portions of the panels 40 and cooperates with its associated end riser sections 25 to define a pair of recesses 47 having the same dimensions as the recess 27 of the end log 13. Medial riser section 55 is made of the same stock as the end riser sections 25 and comprises panels 59, 59 and a honeycomb core 61.

Enclosure panel 17 comprises a pair of rectangular panels 69, 69 and a honeycomb 71 and preferably is made of the same stock as the riser sections 25 and 55. Thus, all of the elements of the kit may be fabricated from only two stocks of honeycomb core kraft material. Typically, the logs 13 and 15 are 4 inches square in section, with the main body sections of the logs being 4 inches wide and 3 inches high, the riser sections and enclosure panels being $\frac{1}{2}$ inch high, and the recesses 27 and 47 being approximately $4\frac{1}{4}$ inches long. Also, the logs may be made in any number of standard lengths, such as, approximately 8 inches for the end log 13, and 24 and 48 inches for the wall logs 15. The enclosure panels 17 may be 24 inches by 48 inches by $\frac{1}{2}$ inch in height.

Figure 4:
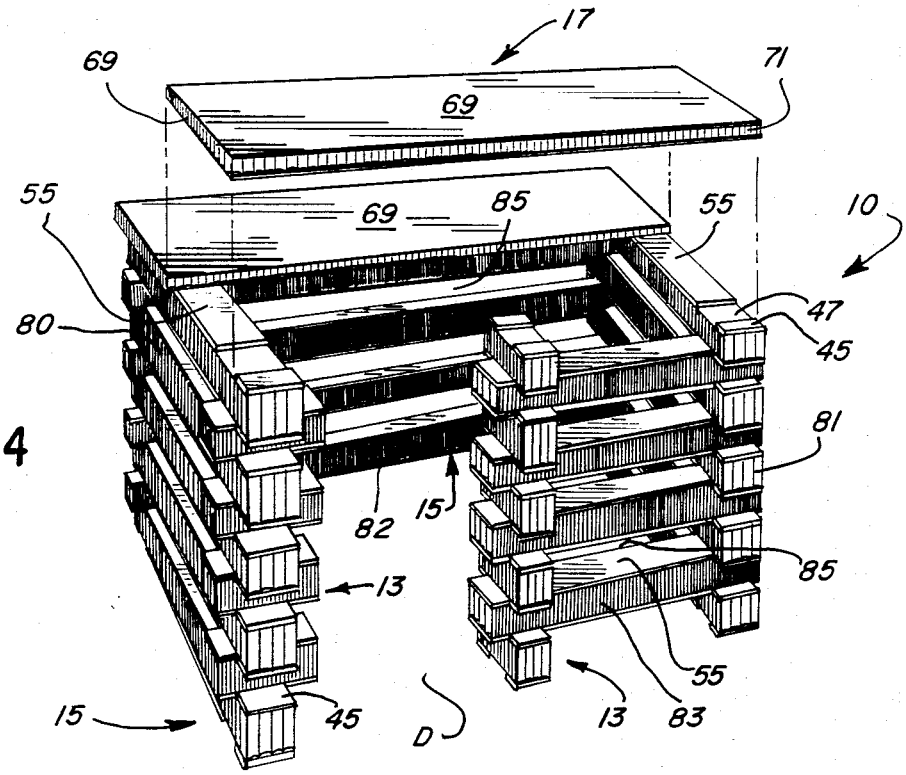
FIG. 4 is a partially exploded perspective view of a typical life-size play structure built with the building blocks of the invention.

Referring to FIG. 4, it will be seen how the elements 13, 15, and 17 may be employed to construct a typical play house having side walls 80, 81, a rear wall 82, a front wall 83, and a doorway D. Wall logs 15 are stacked vertically, from the floor up, to form the house side walls 80 and 81. At their rear ends, the logs 15 of the side walls are interlocked by additional wall logs 15 vertically stacked in alternating relationship to form the rear wall 82. In this instance, all of the wall logs 15 may comprise the same length, for example 48 inches.

At the free front end of the side wall 80, the logs 15 are interlocked with alternating end logs 13. At the front end of the side wall 81, the logs 15 are interlocked with additional alternating wall logs 15 which, in this instance, may be 24 inches in length and form the front wall 83. At the free end of the front wall 83, those logs 15 are interlocked with alternating end logs 13, thereby forming the doorway D. A pair of roof panels 17 resting on the riser sections 25 and 45 completes the play house.

It will be noted that all of the logs 13 and 15 are locked within at least one recess 27 or 47 to provide a sturdy play house requiring no fasteners or adhesives. This arrangement likewise provides open air and light spaces 85 between the stacked logs. The entire house may, of course, be as readily disassembled and the elements thereof stored.

Various modifications are contemplated and may obviously be resorted to by those skilled in the art without departing from the spirit and scope of the invention, as hereinafter defined by the appended claims, as only a preferred embodiment has been disclosed.

What is claimed is:

1. A toy construction kit for erecting life-size playhouses comprising:

a plurality of kraft paper building blocks having a pair of opposite surfaces and being substantially square in section, said building blocks comprising a composite, three-tier honeycomb structure between said opposite surfaces, and a recess formed in each of said opposite surfaces, said recess being substantially shallower than the distance between said opposite surfaces, each said building block honeycomb structure comprising a main body section and flat riser sections secured to said main body sections to form said opposite surfaces, said main body section and said riser sections each comprising a separate honeycomb core, and said riser sections defining the sides of said recesses, each said honeycomb core comprising a plurality of individual cells having a longitudinal axis extending transversely of said opposite surfaces, whereby a building block can accommodate and interlock with another building block in said recesses so that said opposite surfaces are always in vertically spaced relationship with the next adjacent block, the vertical spacing between blocks permitting the entry of ambient air and light into a playhouse built of said bblocks.

2. A toy construction kit according to claim 1 in which some of said building blocks comprise three of said riser sections on each of said opposite surfaces, said three riser sections defining a pair of recesses, one adjacent each end of said opposite surfaces.

3. A toy construction kit according to claim 1 in which the honeycomb core of said riser sections is approximately one-sixth the length of the honeycomb core of said body section.

4. A toy construction kit according to claim 1 in which said recess has a depth of approximately one-eighth the distance between said opposite surfaces.

5. A toy construction kit according to claim 3 and comprising further a rectangular closure panel adapted to rest atop a pair of said building blocks, said panel comprising a honeycomb core structure made from the same stock as said riser sections.

6. A toy construction kit according to claim 1 in which said main body section and said riser sections each comprises paper panels and a honeycomb core between said paper panels.

7. A life-size temporarily habitable playhouse fabricated entirely of kraft paper comprising:

square end logs having a recess formed in each of the opposite surfaces thereof and comprising a three-tier honeycomb structure between said opposite surfaces; and square wall logs having a pair of recesses formed in each of the opposite surfaces thereof adjacent the ends of said surfaces and comprising a three-tier honeycomb structure between said opposite surfaces, each three-tier honeycomb structure comprising a main body section and flat riser sections secured to a said main body section to form said opposite surfaces, said main body section and said riser sections each comprising a separate honeycomb core, and said riser sections defining the sides of said recesses, each said honeycomb core comprising a plurality of individual cells having a longitudinal axis extending transversely of said opposite surfaces, said recesses having a depth of approximately one-eighth the distance between the opposite surfaces of said end logs and wall logs, said end logs and wall logs being built up in crossed interfitting relationship at said recesses so that each log is in vertically spaced relationship with the log immediately thereabove and therebelow, the vertical spacing between logs permitting the entry of ambient air and light into the playhouse.

* * * * *